United States Patent [19]

Green, Jr.

[11] Patent Number: 4,751,487

[45] Date of Patent: Jun. 14, 1988

[54] DOUBLE ACTING PERMANENT MAGNET LATCHING SOLENOID

[75] Inventor: James E. Green, Jr., Germantown, Wis.

[73] Assignee: Deltrol Corp., Bellwood, Ill.

[21] Appl. No.: 26,109

[22] Filed: Mar. 16, 1987

[51] Int. Cl.[4] ..... H01F 7/08

[52] U.S. Cl. ..... 335/234; 335/230; 335/79

[58] Field of Search ..... 335/229, 230, 234, 78, 335/79, 84

[56] References Cited

U.S. PATENT DOCUMENTS

| | | | |
|---|---|---|---|
| 2,833,968 | 5/1958 | Karlson | 335/234 |
| 3,202,886 | 8/1965 | Kramer | 335/234 |
| 3,460,081 | 8/1969 | Tillman | 335/234 |
| 3,514,674 | 5/1970 | Ito | 361/194 |
| 3,634,735 | 1/1972 | Komatsu | 361/194 |
| 3,859,547 | 1/1975 | Massie | 335/234 X |
| 4,419,643 | 12/1983 | Ojima et al. | 335/234 |
| 4,442,418 | 4/1984 | Myers | 335/234 X |
| 4,514,710 | 4/1985 | Conrad | 335/230 |

*Primary Examiner*—George Harris
*Attorney, Agent, or Firm*—John L. Harris

[57] ABSTRACT

A solenoid which is driven positively in both directions by reversal of coil current and held in place at either end by flux from a permanent magnet located at the center of the frame. The permanent magnet is formed of two opposed sections fitting tightly between the plunger tube and frame, and is located in a space between two coils. In one form the two magnet sections are formed of compressible material and are recessed to fit closely around the plunger tube.

18 Claims, 1 Drawing Sheet

FIG. 1
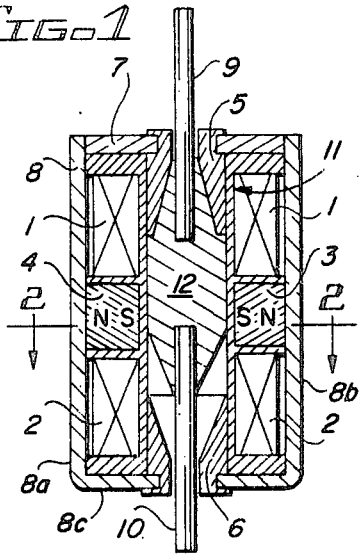
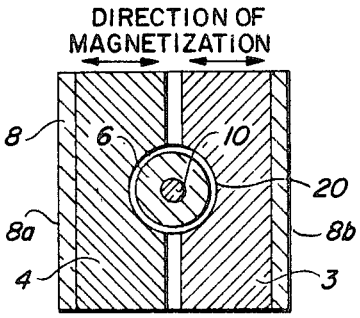
FIG. 2
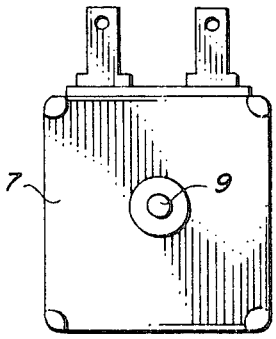
FIG. 3
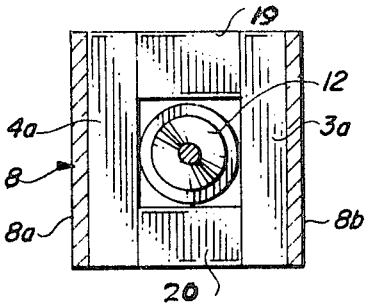
FIG. 4
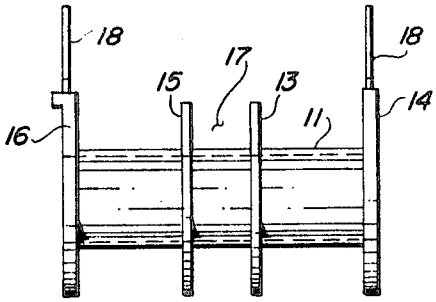
FIG. 5
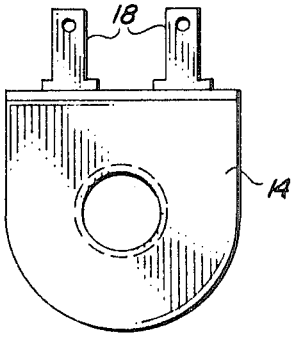
FIG. 6
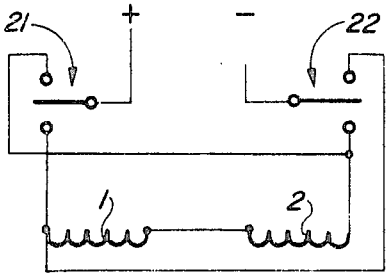
FIG. 7

DOUBLE ACTING PERMANENT MAGNET LATCHING SOLENOID

BACKGROUND OF THE INVENTION

This invention relates to solenoids in which the plunger is held or "latched" in position after deenergization by means of a permanent magnet.

Some applications for solenoids require that a solenoid plunger be moved to one position by instantaneous energization of a coil and held there indefinitely after the coil is deenergized. This holding or latching has been accomplished by a permanent magnet which holds until its flux is countered by opposing flux from the coil.

Other applications require that the plunger be held in either end position when no power is applied to the solenoid. This has required two separate permanent magnets, one at each end of the solenoid.

In U.S. Pat. No. 4,514,710, Apr. 30, 1985, this double holding action is achieved with a single permanent magnet mounted on the solenoid frame midway between its two ends. This establishes a magnetic flux around both ends of the frame and through the plunger. This flux holds the plunger in the end it happens to be in.

The patented construction, however, requires a costly large ring of magnetic material around the plunger tube for distributing magnetic flux to the plunger. It also involves assembly steps making the double latching solenoid quite expensive.

SUMMARY OF THE INVENTION

The present invention provides for double magnetic latching action with a permanent magnet located midway in the frame to provide a flux path around both ends of the solenoid. The primary object of the invention is to provide such a permanent magnet and solenoid construction which is inexpensive to produce, which is easily assembled without fasteners, and which is reliable and effective to provide the desired latching operation.

In the preferred embodiment, this object is achieved by splitting the permanent magnet into two simple low cost sections, one on each side of the plunger tube. The sections are recessed semi circular to receive the plunger tube. This provides for fast assembly and at the same time achieves a flux path through the plunger tube over a substantial area. These magnet sections are held in place by pressure against the solenoid frame and the plunger tube and are located axially on the plunger tube by flanges which also serve to facilitate coil winding.

Other objects will appear from the following description and appended claims.

BRIEF DESCRIPTION OF DRAWING

FIG. 1 is a sectional elevation of the permanent magnet double acting latching solenoid.

FIG. 2 is a section taken on line 2—2 of FIG. 1.

FIG. 3 is an upper end view of the solenoid.

FIG. 4 is a section similar to FIG. 2, but showing a modified permanent magnet construction.

FIG. 5 is a side view of the combination plunger tube and bobbin construction.

FIG. 6 is an end view of this bobbin showing the coil terminals.

FIG. 7 is a wiring diagram showing the external witches for reversing current direction through the coils.

DESCRIPTION OF THE PREFERRED EMBODIMENT

Referring to FIGS. 1 and 2, a solenoid frame is formed by a U shaped frame member 8 having two upwardly extending legs 8*a* and 8*b* connected by a laterally extending end portions 8*c*. The upper end of the frame is closed by a laterally extending end portion or plate 7 which is staked to the frame 8 as shown in FIG. 3. An upper backstop 5 is attached by staking to plate 7 and a lower backstop 6 is attached to end plate 8*c*. These backstops are identical, each having a cylindrical exterior extending into and holding a molded plastic combination plunger tube and coil bobbin 11. The backstops 5 and 6 have conical interiors matching the conical ends of a solenoid plunger 12 having non magnetic push rods 9 and 10 extending through the ends of the solenoid frame.

The combination plunger tube and bobbin is shown more clearly in FIGS. 5 and 6. The plunger tube 11 is formed with a first pair of coil holding flanges 13–14 at one end and a second pair of coil flanges 15–16 at the other end. These pairs of coil flanges are separated by a space 17.

As shown in FIG. 1, solenoid coil 1 is wound between flanges 13 and 14 and coil 2 is wound between flanges 15 and 16. The ends of each coil are separately connected to adjacent pairs of terminals 18. Both coils may be wound at the same time.

As shown in FIG. 1, the space 17 between the sidewalls of flanges 13–15 on the plunger tube is a channel receiving permanent magnet sections 3 and 4. These magnet sections are shown in FIG. 2, and are indentical, but reversed in assembly. Magnet section 3 has its right hand face fitting against the intermediate frame portion 8*b* and extends the entire width of the frame. As shown in FIG. 1 magnet section 3 has opposite faces parallel with the frame portion 8*b* and with the plunger tube 11. This gives intimate contact of the magnet 3 with both the plunger tube and frame. The area of contact with the plunger tube is increased substantially by the recess 20 in the magnet into which the plunger tube closely fits. It will be apparent from FIG. 2 that contact of the magnets with the plunger tube walls is almost a full circle.

The construction described is easy to assemble, requires no fasteners and only three staking operations. In assembly, the backstrops are staked to the frame 8 and end plate 7. Then the magnets are inserted in the space 17 of the completed coil assembly, which is then insert in the frame over backstop 6. The plunger assembly is then inserted in the plunger tube and the end plate is staked in place. The magnets are held in place by pressure between the frame sidewalls and the plunger tube. They are locked in place endwise by contact with the recess walls of the plunger tube.

Preferably the magnet sections 3 and 4 are made of compressible magnetic material. One such material is available under the trade mark "PLASTIFORM". This material has a cured (vulcanized) nitrile rubber binder containing oriented barium magnetic ferrite magnet material. The magnets may be punched from a strip of this material, making them inexpensive to produce. The advantage of the compressible magnets is they may be made slightly oversize and are compressed in assembly. This insures that the magnets fit tightly between the frame and plunger tube and between flanges 13 and 15. A press fit between the magnets and flanges 13 and 15 is not needed. However a reasonably close fit has the advantage of locating the magnets accurately at the frame center.

FIG. 4

This figure shows a modification in which the magnets 3a and 4a are straight bars of a highly magnetic material such as the well known "Alnico". They are not recessed and are held tightly against frame members 8a and 8b by spacers 13 and 14. With this material, recessing of the magnets as in FIG. 2 is not needed because of the strong magnetic strength of "Alnico".

OPERATION

The arrangement shown causes the centrally located permanent magnet means 3–4 to have two flux paths through the frame and plunger, one holding the plunger in its upper position as shown and the other for holding the plunger in its down position. The upper flux path is from the magnetic north pole upwardly through frame 8, plate 7 and downwardly through backstop 5 and plunger 12 to the south pole of magnet 3–4. The lower flux path is from the magnet north pole downwardly through frame 8, backstop 6, the air gap and plunger 12 to the magnet south pole.

In the position shown, the plunger is in its upper position against the upper backstop and an air gap exists between the plunger and the lower backstop. This air gap greatly reduces the flux intensity in the lower flux path, allowing the permanent magnet to hold the plunger in its upper position.

If the upper coil winding is energized with a polarity to produce an upward magnetic field overcoming the downward polarity of the magnetic field, the plunger will move to its down position.

Preferably both coils are used simultaneously to move the plunger. The wiring diagram for this is shown in FIG. 7. The coils may be connected in series or in parallel.

When the switches 21 and 22 are in the down positions as shown in FIG. 7, current flows through both coils in a direction inducing an upward flux in the plunger. This opposes the downward permanent magnet flux at upper backstop 5 and adds to the upward permanent magnet flux between the plunger and lower backstop 6. This causes the plunger to move to the down position where it is "latched" or held by the permanent magnet when the coils are deenergized.

When the plunger is in its down position, upward movement of the switches causes current flow through the coils in the opposite direction causing the plunger to move back to its upper position.

I claim:

1. In a permanent magnet latching solenoid, the combination of, the frame means having an intermediate portion and two laterally extending end portions, plunger tube means extending between said end portions, a magnetic solenoid plunger in said plunger tube means, permanent magnet means spaced from said end portions and located between said intermediate portion and the plunger tube means, one face of the permanent magnet means fitting against said intermediate portion of the frame means, the opposite face of the permanent magnet means being substantially parallel with the plunger tube means, engagement of the permanent magnet means with the intermediate portion of the frame means and the plunger tube means contributing to the support of the permanent magnet means; said permanent magnet means being magnetized in a manner to cause one magnetic pole to be adjacent said intermediate portion of the frame means and the opposite magnetic pole to be adjacent the plunger tube means, providing a permanent magnet flux through the frame means and plunger, and externally controlled coil means affecting the permanent magnet flux to cause movement of the plunger.

2. The combination recited in claim 1 in which the permanent magnet means is formed of flexible magnetic material and is held in place by compression thereof.

3. The combination recited in claim 1 in which the plunger tube means supports a first pair of coil flanges at one end and a second pair of coil flanges at the other end, the coil means consisting of separate coils wound between the flanges, said pairs of coil flanges being spaced apart providing a space receiving the permanent magnet means.

4. The combination recited in claim 3 in which the flanges accurately locate the permanent magnet means in said space.

5. In a permanent magnet latching solenoid, the combination of frame means having an intermediate portion and two laterally extending end portions, plunger tube means extending between said end portions, a magnetic solenoid plunger in said plunger tube means, permanent magnet means spaced from said end portions, a side of said magnet means being adjacent said intermediate portion, said magnet means being formed with a recess formed to provide a flux path from the permanent magnet means through the plunger tube means extending over a substantial area, said permanent magnet means being magnetized in a manner to cause one magnetic pole to be adjacent said intermediate portion of the frame means and the opposite magnetic pole to be adjacent the plunger tube means, providing permanent magnet flux through the frame means and plunger, and externally controlled coil means affecting said permanent magnet flux to cause movement of the plunger.

6. The combination recited in claim 5 in which the permanent magnet means is in firm engagement with said intermediate portion of the frame means and plunger tube means.

7. The combination recited in claim 5 in which the permanent magnet means is held in place by pressure from the frame means and plunger tube means.

8. The combination recited in claim 5 in which the permanent magnet means is formed of flexible material and is held in place by compression thereof.

9. The combination recited in claim 5 in which the plunger tube means supports a first pair of coil flanges at one end and a second pair of coil flanges at the other end, the coil means consisting of separate coils wound between the flanges, said pairs of coil flanges being spaced apart providing a space receiving the permanent magnet means.

10. The combination recited in claim 9 in which the flanges accurately locate the permanent magnet means in said space.

11. In a permanent magnet latching solenoid, the combination of, frame means of magnetic material including opposed parallel side sections and two parallel end plates, plunger tube means extending between the end plates parallel with the side sections, a magnetic solenoid plunger in said plunger tube means, permanent magnet means spaced from said end plates, said permanent magnet means comprising two separate permanent magnets on opposite sides of the plunger tube means and facing each other, one magnet having a face adjacent one side section and another face adjacent the plunger tube means, the other magnet having a face adjacent the other side section and another face adjacent the plunger tube means, said permanent magnets each being magnetized having the same magnetic pole adjacent the side sections and the opposite magnetic pole adjacent the plunger tube means providing a permanent magnet flux through the frame means and plunger, and externally controlled coil means affecting the permanent magnet flux to cause movement of the plunger.

12. The combination recited in claim 11 in which the plunger tube means supports a first pair of coil flanges at one end and a second pair of coil flanges at the other end, the coil means consisting of separate coils wound between the flanges, said pairs of coil flanges being spaced apart providing a space receiving said permanent magnets.

13. The combination recited in claim 11 in which at least one of the permanent magnets is formed with a recess receiving the plunger tube means said recess being formed to provide a flux path from said one permanent magnet through the plunger tube means extending over a substantial area.

14. The combination recited in claim 11 in which at least one permanent magnet is formed of compressible magnetic material and is held in place by compression thereof.

15. The combination recited in claim 13 in which said one permanent magnet is formed of compressible material and is held in place by compression thereof.

16. The combination recited in claim 11 in which the permanent magnets are rectangular bars extending across the side sections and held in place by two spacers extending between the magnets on opposite sides of the plunger tube means.

17. In a permanent magnet latching solenoid, the combination of, frame means having an intermediate portion and two laterally extending end portions, plunger tube means extending between said end portions, a magnetic solenoid plunger in said plunger tube means, permanent magnet means having a first pair of opposite faces, one face being adjacent said intermediate portion of the frame means and the opposite face being adjacent the plunger tube means, said plunger tube means being formed with an external channel having sidewalls, said permanent magnet means being located in said channel and having a second pair of opposite faces adjacent said sidewalls, at least one of said pairs of faces fitting tightly with its adjacent structure to hold the magnet means in place.

18. The combination recited in claim 17 in which the permanent magnet means is formed of compressible material and is held in place by compression thereof.

* * * * *